United States Patent [19]

Lorenz et al.

[11] 4,126,603

[45] Nov. 21, 1978

[54] GLOSS-STABLE MODACRYLIC FIBRES

[75] Inventors: Günter Lorenz, Dormagen-Hackenbroich; Alfred Nogaj, Dormagen; Helmut Miller, Dormagen; Hans Wilsing, Dormagen, all of Fed. Rep. of Germany

[73] Assignee: Bayer Aktiengesellschaft, Leverkusen, Fed. Rep. of Germany

[21] Appl. No.: 752,738

[22] Filed: Dec. 21, 1976

[30] Foreign Application Priority Data

Dec. 23, 1975 [DE] Fed. Rep. of Germany ..... 2558384

[51] Int. Cl.[2] ..... C08F 28/00

[52] U.S. Cl. ..... 526/240; 264/206; 526/342; 526/287

[58] Field of Search ..... 264/182, 206; 526/342; 260/79.3 M

[56] References Cited

U.S. PATENT DOCUMENTS

| | | | |
|---|---|---|---|
| 3,943,223 | 3/1976 | Kozuka et al. | 264/182 |
| 4,002,809 | 1/1977 | Kozuka et al. | 264/182 |
| 4,014,958 | 3/1977 | Miessen et al. | 264/182 |
| 4,056,516 | 11/1977 | Albers et al. | 264/182 |
| 4,056,517 | 11/1977 | Albers et al. | 264/182 |

FOREIGN PATENT DOCUMENTS

| | | | |
|---|---|---|---|
| 2,454,322 | 5/1976 | Fed. Rep. of Germany | 264/206 |
| 2,502,195 | 7/1976 | Fed. Rep. of Germany | 264/206 |
| 47-8,772 | 3/1972 | Japan | 264/182 |

*Primary Examiner*—Jay H. Woo

*Attorney, Agent, or Firm*—Plumley and Tyner

[57] ABSTRACT

The invention relates to gloss-stable modacrylic fibres and filaments comprising 50 to 84% of acrylonitrile, 15 to 48% of vinylidene chloride and 2 to 5% of an olefinically unsaturated sulphonic acid or salt thereof, all percentages being by weight, having a shrinkage in boiling water of at most 0.3%, a reduction in density on treatment with boiling water of no more than 0.015 g/cc and a scattered light component after boiling of at most 35 units compared with a $BaSO_4$ standard of 1000 units, the increase brought about by treatment with boiling water amounting to no more than 30 units as well as to a process for their production.

2 Claims, No Drawings

GLOSS-STABLE MODACRYLIC FIBRES

This invention relates to modacrylic fibres, which are dry spun from polar solvents, of copolymers of acrylonitrile and vinylidene chloride, an unsaturated sulphonic acid and, optionally, another comonomer, which are insoluble in acetone and which have a compact structure, minimal shrinkage and high gloss retention, and also to a process for their production.

Halogen-containing modacrylic fibres are acquiring increasing importance as materials for textiles with reduced inflammability. Numerous fibres consisting essentially of copolymers of acrylonitrile with vinyl chloride or vinylidene chloride are already in use. Due to their relatively high softening point, the vinylidene chloride compolymers are of particular interest for multipurpose use as textile fibres.

Conventional fibres of this type are primarily fibres which are soluble in acetone and which are produced from that solvent either by wet or dry spinning. One disadvantage of these known modacrylic fibres is their high thermoplasticity and accordingly their inherent tendency towards considerable shrinkage under hot-wet conditions. In addition, when boiled or dyed in hot solution, the fibres undergo a marked reduction in gloss and become opaque. This phenomenon is caused by the formation of microscopic cavities in the fibres which produce a pronounced scattering of light. These micropores are referred to in the literature as vacuoles. The reduction in gloss through vacuole formation can be measured from the increase in the intensity of the scattered light and from the reduction in density after treatment with boiling water.

In the processing of the fibres on a commercial scale, vacuole formation is particularly troublesome during dyeing insofar as it causes relatively light, uneven dyeing and, in some cases, even a change in color in cases where combination dyes are used. In the case of dry spun acrylic fibres, which show particularly high surface gloss and good textile properties, for example strength and elongation, the problem of vacuole formation may be regarded as substantially solved.

It is desirable to make modacrylic fibres, despite their different chemical composition, as similar as possible to acrylic fibres. Modacrylic fibres can also be produced by dry spinning. Unfortunately, conventional fibres of this type are particularly prone to vacuole formation.

However, it is basically not possible to apply the methods for producing compact, gloss-stable, shrinkage-free acrylic fibres to modacrylic fibres containing less than 85% of acrylonitrile units, because modacrylic fibres have a much greater tendency to develop porous structures, but also they show increased thermal sensitivity. As a result, it is not possible to apply high temperatures for consolidating the fibre structure. Furthermore, gloss cannot be stabilized by the action of dry heat alone on a drawn, porous modacrylic fibre.

Although numerous gloss-stabilizing additives for modacrylic fibres, for example polyvinyl pyrrolidone or polyacrylic acid — N,N-dimethyl amide, have already been proposed and even perform their function so far as gloss stabilization is concerned, they nevertheless give rise to problems attributable to excessive yarn shrinkage, reduced softening point and a greatly increased dyeing rate.

It is desirable that the fibres should undergo as small a change in length as possible when heated and especially as little elongation or shrinkage as possible when treated with dry heat at temperatures of from about 100° to 150° C, because in the textile field drying processes are frequently carried out on woven fabrics in this temperature range, for example on tentering frames.

In addition it is desired that modacrylic fibres should undergo as small a change in length as possible under the effect of boiling water or saturated steam.

However, the modacrylic fibres available on the market all have a boiling-induced fibre shrinkage of more than 0.5%. Experience has shown that it is no longer possible safely to produce a fibre yarn with a boiling-induced shrinkage of less than 4.5%, although this is essential for the so-called cheese-dyeing method frequently used for dyeing.

A halogen-containing gloss-stable modacrylic fibre dry spun from polar solvents, such as dimethyl formamide and dimethyl acetamide, with a fibre shrinkage of less than 0.3% and a uniform, compact structure without vacuole formation when treated with hot water, would be entirely novel.

In addition, conventional halogen-containing modacrylic fibres have a relatively low softening point which is generally below 200° C. The position of the softening point is governed both by the composition of the fibres and also by their pretreatment.

Accordingly, there is still a considerable commercial interest in gloss stable modacrylic fibres which are as similar as possible to acrylic fibres in regard to dyeability and which also have minimal shrinkage and low thermal placticity, so that they may be processed in the same way as acrylic fibres, more especially by cheese dyeing and piece dyeing.

Accordingly, the object of the present invention is to provide modacrylic fibres, which have a softening point above 200° C and a boiling-induced fibre shrinkage of less than 0.5% and which at the same time are gloss-stable, and also a process for their production.

In the context of the invention, gloss-stable modacrylic fibres are fibres which have a homogeneous compact structure, which do not undergo any significant vacuole formation when treated with hot water at temperatures above 80° C and, as a result, show an increase in the amount of scattered light of at most 30 units to a total of at most 35 units for a barium sulphate standard of 1000 units. The low increase in scattered light is accompanied by a small reduction in density of at most 0.015% g/cc, although greater practical significance is attributed to the scattered light measurement from the point of view of optical effect. There objects are accomplished by a process for the production of modacrylic fibres by dry spinning a solution of a copolymer, consisting of 50 to 84% by weight of acrylonitrile, 15 to 48% by weight of vinylidene chloride, 2 to 5% by weight of olefinically unsaturated sulphonic acid or its salts and, optionally, up to 15% by weight of at least one other copolymerised monomer, with a K-valve according to Fikentscher of from 65 to 100, in a polar organic solvent, characterized by the fact that the filaments are dried in the spinning duct to a residual solvent content of no less than 12% by weight, based on the dry mass, are subsequently drawn in water at 60° to 100° C to between 1.8 and 7 times their original length, are continuously dried at 110° to 170° C with a permitted shrinkage of from 0 to 40% of the drawn length and are fixed and stabilized by a steaming treatment carried out for 2to 6 minutes at a temperature of from 105° to 120° C with the steam kept at a saturation concentration of from 90 to 99%.

It is possible by this process to produce gloss-stable modacrylic fibres and filaments which have a shrinkage in boiling water of at most 0.3%, undergo a reduction in density of no more than 0.015% g/cc when treated with boiling water and have a scattered light component after boiling of at most 35 units for a $BaSO_4$ standard of 1000 units, the increase brought about by treatment with boiling water amounting to no more than 30 units.

The invention also relates to these modacrylic fibres and filaments.

According to the invention, the modacrylic polymers used consist of 50 to 84% of acrylonitrile, 15 to 48% of vinylidene chloride (1,1-dichloroethane), 2 to 5% of an olefinically unsaturated sulphonic acid and, optionally, up to 15% by weight of at least one other copolymerizable compound. Other copolymerizable compounds are, in particular, aliphatic esters of acrylic acid and methacrylic acid, preferably (meth)acrylic acid methyl and ethyl ester, (meth) acryl amide and N-substituted (meth)acryl amides, such as for example N-methyl acryl amide, vinyl compounds such as vinyl acetate, styrene or halogen-containing compounds for example, vinyl chloride or vinyl bromide.

Of the group of unsaturated sulphonic acids, it is preferred to use vinyl sulphonic acid, allyl and methallyl sulphonic acid, styrene sulphonic acid, acryloyl dimethyl taurine and their alkali metal alkaline earth metal or ammonium salts.

The production of these modacrylic polymers is best carried out in accordance with the known principles of precipitation polmerisation in aqueous medium, as described for example in German Offenlegungsschrift No. 2,063,328.

The modacrylic polymers used should have a K-value according to Fikentscher of from 65 to 100. For reasons of spinning technology, a range from 70 to 85 is preferred.

For producing the gloss-stable high-density modacrylic fibres according to the invention, the polymers must contain an adequate quantity of acid groups. The sulphonate groups may be introduced either by copolymerizing the unsaturated sulphonic acids, but also by decomposing the redox initiator system where persulphate/hydrogen sulphite is used. In cases where, for example, vinyl sulphonic acid, allyl sulphonic acid or methallyl sulphonic acid is used as the unsaturated sulphonic acid, it is not possible by chemical or spectroscopic methods to draw a distinction between the sulphonate groups derived therefrom and the terminal sulphonate groups emanating from the redox system. Both types of sulphonate groups are picked up.

It is possible to determine the total number of acid groups by titrating the polymer in dimethyl sulphoxide (DMSO) after passing through a column filled with an ion exchanger, although this method is not very accurate because the reaction of the modacrylic polymer with DMSO cannot be completely ruled out and, as a result, can lead to an incorrect result.

A simple and sufficiently accurate method has been found for assessing the number of strongly acid groups present in a polymer or in a fibre. This method comprises dissolving 800 mg of the sample to be tested in 80 ml of dimethyl formamide which has been treated beforehand with a mixed bed ion exchanger, treating this 1% solution with approximately 5 g of the same mixed bed exchanger which should be fresh, but not too moist, and after the exchanger has settled measuring the electrical conductivity of the solution with a conventional conductivity measuring cell.

DMF treated with exchanger has a conductivity of less than 0.5 $\mu$ Siemens. By virtue of the presence in them of sulphonic acid groups, the polymers show electrical conductivity in DMF solution. The conductivity of the samples pretreated in the manner described above should amount to at least 30 $\mu$S, corresponding to a copolymerized quantity of unsaturated sulphonic acid of approximately 2%.

Series measurements have shown that the conductivity values are highly reproducible and show a dispersion of at most $\pm$ 0.5 units. With polymers having an electrical conductivity of lower than 30 $\mu$S in 1% solution, it is not possible to produce gloss stable high-density fibres.

The modacrylic copolymers thus produced are then dissolved in polar solvents, preferably dimethyl formamide (DMF) or dimethyl acetamide (DMA) stabilisers against thermal degradation of the polymers or agents for increasing the light stability of the fibres subsequently produced optionally being incorporated at this stage. The spinning solutions used preferably have viscosities of from 200 to 600 P. They are processed into filaments by known dry spinning methods carried out in heated vertical spinning ducts, a hot spinning gas being simultaneously injected into the duct.

According to the invention, the spinning process is carried out by controlling the take-off rate and the temperatures of the spinning solution, spinning gas and duct heating system so that, after leaving the duct the filaments still have a residual solvent content of at least 12%, based on dry mass. The residual solvent content preferably amounts to between 14% and 20% by weight. It has surprisingly been found that spun material which has been overdried to a residual solvent content of less than 12% cannot be subsequently gloss-stabilized.

After leaving the spinning duct, the freshly spun filaments may optionally be wetted with water, deposited into spinning cans and thus collected.

For further aftertreatment, the filaments are subjected to a drawing treatment in which they are preferably drawn in a ratio of 1:1.1 to 1:3 in a first bath at a temperature in the range from 60° to 100° C and then in a ratio of 1:2 to 1:6 in a second bath at temperatures in the same range, the total stretching ratio amounting to between 1:1.8 and 1:7. They are then preferably washed in water which has been heated to between 60° and 95° C.

In a varient of this process, it is also possible to carry out the washing treatment at an intermediate stage between the two drawing stages.

In addition, the entire drawing operation may even be carried out in a single stage, followed by a single stage or multistage washing treatment.

However, the drawing operation is preferably carried out in two stages by one of the methods described above. It has been found to be favorable so far as the uniformity of the filaments and reliability of the process are concerned to select the temperature in the first drawing zones which are somewhat lower than the temperatures in the second zone which is preferably kept just below the boiling point.

The temperature of the washing liquid is preferably about 10° to 30° C lower than the temperature of the second drawing zone, which applies both to the sequence of drawing-drawing-washing and to the sequence of drawing-washing-drawing.

It is possible in this way to obtain smooth, uniform bunches of filaments already contain a very small number of internal vacuoles, appear highly transparent and show a high surface gloss before they are dried.

After the drawing and washing treatment the filaments are preferably treated with a standard commercial-grade antistatic agent in order to avoid electrostatic charging during their further processing.

The wet, prepared slivers are then delivered to a continuously operating cylinder or drum dryer where they are dried under the combined effect of hot air and the heated cylinder surface. In this process step, the tendency towards shrinkage inherent in the material may be removed to an extent adjusting a speed difference between entry and exit. The permitted shrinkage amounts to between 0% and 40% of the drawn length.

The temperatures adjusted during the drying process are governed by the water content of the drawn cable, by the speed, by the width of the tow and by the shrinkage adjusted in the dryer and also by its length. Drying temperatures in the range from 110° to 170° C have proved to be particularly favorable.

It is particularly favorable for the dried tows to have a residual shrinkage of from 8% to 15%, because this leaves the fibres with the best properties so far as textile processing is concerned. This residual shrinkage is ultimately removed on completion of the manufacturing process i.e., during the steam fixing stage.

It is known that a vacuole-containing moist fibre becomes glossy on contact with a hot surface, the vacuoles disappearing.

However, it has been found that a fibre made glossy in this way again forms vacuoles and becomes dull when treated with boiling water. Surprisingly even prolonged tempering in dry heat does not have any stabilizing effect against renewed vacuole formation. Although even a tow of a modacrylic polymer of 38% of vinylidene chloride, 60% of acrylonitrile and 2% of methallyl sulphonic acid (in the form of its sodium salt), is a glossy yellow-brown in color and completely vacuole-free after tempering for 10 minutes at 160° C, it takes on a milky opaque appearance again when boiled in water. Accordingly, the material is not vacuole-stabilized merely by tempering in dry heat.

Surprisingly, a modacrylic fibre material of this kind can be vacuole-stabilized by steaming under suitable conditions.

To this end, the tows dried in the manner described above are preferably crimped in the usual way, cut into staple fibres and the staple fibres thus obtained are subjected to steam fixing for 2 to 10 minutes and preferably for 3 to 5 minutes with a steam saturation of 90 to 99% and at a temperature in the range from 105° to 120° C.

It is important that the fibres do not become wet as a result of the condensing steam during this steaming process because otherwise a boiling water effect is produced and results in pronounced, irreversible vacuole formation.

The fixing process may be carried out both in batches in closed steaming autoclaves, and also in continuously operating steaming apparatus. The continuous procedure is preferred for economic reasons.

In this case, it is necessary, in order to obtain adequate steam saturation, to provide for effective sealing against the atmosphere at the fibre entrance and exit by suitably constructing the steaming apparatus. The production of an excess pressure of up to 1 bar has a favorable effect in preventing extraneous air from entering.

The modacrylic fibres thus produced resemble acrylic fibres to a considerable extent. They show high dimensional stability. Their boiling-induced shrinkage amounts to less than 0.3%. Their reduction in density on treatment with boiling water amounts to no more than 0.015 g/cc, and they show a scattered light component after boiling of at most 35 units for a $BaSO_4$ standard of 1000 units, the increase brought about by treatment with boiling water amounting to no more than 30 units. For determining the scattered light, fibres previously cut to a length of 2 to 3 mm are weighed into cuvettes wth a black polished base plate and having a diameter of 10 mm and a height of 3 mm. The cuvettes are filled with immersion oil, care being taken to ensure that no air bubbles remain trapped between the fibres. Thereafter the cuvettes free from air bubbles are covered with a glass cover. With a 45° incident light beam, reflection is measured at 0°. The light reflected by the sample is indicated by way of a photocell on a galvanometer. A barium sulphate plate with a scattered light value of 1000 scale graduations on the galvanometer is used as comparison and standard.

The invention is further illustrated but by no means limited by the following Examples:

EXAMPLE 1

A modacrylic polymer with a K-value of 75.4 according to Fikentscher, consisting of acrylonitrile, vinylidene chloride and methallyl sulphonic acid, with a chlorine content of 28.3% and a conductivity of 33.5 $\mu$ Siemens in the form of a 1% solution in DMF after treatment with a mixed bed ion exchanger was dissolved in dimethyl formamide to form a 37% solution.

After preheating to 115° C, the spinning solution was dry spun through a 240 bore spinneret, the filaments being run off from the spinning duct at a rate of 250 meters per minute. The spun material still contained 16% of DMF.

The spun filaments were wetted with water and collected in cans. For aftertreatment, a number of slivers were combined so that a weight per meter of 37 g was obtained after drawing and drying.

The aftertreatment was carried out as follows: the tow was initially drawn in hot water at 94° C in a ratio of 1: 1.63 of its original length, washed at 70° C and then redrawn at 96° C in a ratio of 1:2.45. The overall drawing ratio thus amounted to 1:4.0. The drawn tow was treated with an antistatic agent and dried by means of hot cylinders at 160° C in a continuous drying unit, a shrinkage of 15% being allowed. After drying, the tow had a residual shrinkage of 10%. Take-off rate: 42.5 m/minute.

The dried tow was crimped in a stuffer box in the usual way and cut into staple fibres approximately 60 mm long. The staple fibres were introduced into a continuous steaming apparatus into which 400 kg/h of steam were introduced. A temperature of 107° C prevailed in the steamer for an excess pressure of 8 mm water column. The steam saturation inside the steamer amounted to 96%. After a residence time of 4.5 minutes, the fibres were removed from the steamer and cooled.

A high gloss modacrylic fibre with a supple, pleasant feel was obtained, its properties being as follows:

denier : 6.1 dtex
tensile strength : 2.5 cN/dtex
elongation at break : 49% loop tensile strength : 0.82 cN/dtex
loop elongation at break : 16%
tack point : 215° C
residual fibre shrinkage : 0%
conductivity of the fibres (dissolved in DMF after treatment with ion exchanger) : 34.0 μS
moisture : 1.8%
yarn shrinkage : 2.7%

The filaments had a uniform round cross-section and did not shown any vacuoles under a microscope.

Gloss stability was treated by two different methods:

1. Scattered light measurement

The scattered light of a fibre sample was measured by comparison with an arbitrary barium sulphate standard of 1000 units. The results obtained were as follows:

(a) 3 units in the case of an untreated sample;
(b) 12 units in the case of a sample boiled in water for 30 minutes.

2. Visual vacuole assessment by immersing the fibres in a mixture of 70% of o-nitrotoluene and 30% of chlorobenzene, in which a non-dulled pore-free fibre of the above-mentioned composition is invisible because of equal light refraction. If a fibre forms vacuoles, the following stages become visible, according to the vacuole population:

0 = no vacuoles, fibres invisible
1 = individual fibres weakly visible
2 = a few vacuoles
3 = distinct vacuole formation, fibres visible
4 = heavy vacuole formation, limey appearance.

The fibre produced in the present Example was assessed as follows:

(a) untreated: 0
(b) boiled: 0–1

Accordingly, the fibre is gloss-stable.

The fact that dry heat treatment alone is not sufficient for producing gloss-stability is shown by the following test:

A sliver sample was removed from the dryer during production of the fibres as described above. This sample was glossy and vacuole-free. Scattered light measurement produced the following results:

(a) untreated: 3 units
(b) boiled: 110 units

After boiling, the sliver appeared milky and opaque.

The aftertreatment installation was then stopped and, 10 minutes later, another sample was removed from the dryer. As a result of the temperature of 160° C prevailing throughout this entire period, the sliver sample was distinctly brown in color, but still glossy. Scattered light testing of this sample produced the following results:

(a) untreated: 6 units
(b) boiled: 140 units

Accordingly, gloss was not stabilized by the heat treatment.

EXAMPLES 2 –5

The following Examples 2 – 4 illustrate various applications of the process according to the invention with various fibre deniers. Example 5 is a Comparison Example and shows the inadequate stabilization of gloss obtained in the event of inadequate residence in the steamer.

Tests Nos. 2 to 5 were all carried out with the same polymer as described in Example 1.

| Example No: | 2 | 3 | 4 | 5 |
|---|---|---|---|---|
| Spinneret(number of bores) | 420 | 420 | 420 | 420 |
| Spinning denier dtex | 4.4 | 6.0 | 8.75 | 8.75 |
| Take-off (m/minute) | 300 | 300 | 250 | 250 |
| 1st drawing | 1:1.36 | 1:1.63 | 1:1.63 | 1:1.63 |
| Temperature of 1st drawing (° C) | 94 | 94 | 94 | 94 |
| Washing temperature(° C) | 70 | 70 | 70 | 70 |
| 2nd drawing | 1:2.94 | 1:2.21 | 1:2.45 | 1:2.45 |
| Temperature of 2nd drawing (° C) | 96 | 96 | 96 | 96 |
| Dryer Temperature (° C) | 145 | 140 | 140 | 160 |
| Permitted shrinkage (%)) | 15 | 0 | 15 | 15 |
| Residual tow shrinkage(%) | 11.4 | 11.3 | 11.8 | 9.8 |
| Weight per meter (g) | 34.3 | 33.5 | 30.4 | 37.9 |
| Staple length (mm) | 40 | 50 | 60 | 60 |
| Quantity of steam(kg/h) | 400 | 400 | 400 | 400 |
| Steam temperature (° C) | 1:07 | 107 | 107 | 107 |
| Residence time (Min/sec) | 4'30" | 4'30" | 4'30" | 1'48" |
| Fibre values obtained | | | | |
| Denier dtex | 1.6 | 2.3 | 3.3 | 3.3 |
| Moisture (%) | 1.2 | 1.0 | 1.6 | 1.7 |
| Fibre shrinkage (%) | 0 | 0.1 | 0.2 | 0.2 |
| Yarn shrinkage (%) | 2.0 | 2.0 | 3.5 | 7.4 |
| Scattered light ($BaSO_4$ = 1000) | | | | |
| a) untreated | 7 | 11 | 9 | 25 |
| b) boiled | 9 | 20 | 20 | 150 |
| Vacuoles, visual (boiled) | 0 | 0 | 0–1 | 2–3 |

EXAMPLES 6 AND 7

These Examples demonstrate the influence which different contents of DMF in the spun material for the same polymer have upon vacuole formation in the finished fibre. The polymer which was used consisted of acrylonitrile, vinylidene chloride and methallyl sulphonic acid and had the following properties:

K-value according to Fikentscher 80.6.

Chlorine content 28.2%, conductivity of a 1% solution in DMF after treatment with a mixed bed ion exchanger: 32.6 μ/Siemens.

Spinning was carried out with the same spinneret and at the same speed, the only difference being that the filaments were dried to different extents in the spinning duct by altering the temperature and quantity of the spinning air.

The aftertreatment is the same for both Examples because the spun filaments are subjected to the drawing, washing and drying process at the same time alongside one another. For both Comparison Examples, the steaming process was again carried out successively on the same apparatus.

The following results were obtained:

| Example No. | 6 | 7 |
|---|---|---|
| DMF in spun material (%) | 16.5 | 10.9 |
| Total drawing | 1:4.0 | 1:4.0 |
| Drawing temperature (1 & 2)° C | 94/96 | 94/96 |
| Washing temperature (° C) | 70 | 70 |
| Dryer temperature (° C) | 150 | 150 |
| Permited shrinkage (%) | 15 | 15 |
| Residual tow shrinkage (%) | 11 | 10 |
| Residence time in steamer (min) | 5 | 5 |
| Quantity of steam (kg/h) | 400 | 400 |
| Steam temperature (° C) | 115 | 115 |
| Fibre shrinkage (%) | 0.1 | 0.3 |
| Moisture (%) | 1.0 | 0.7 |
| Vacuoles after boiling, visual | 1 | 2–3 |

Accordingly, the fibre with the lower DMF content in the spun material is not gloss-stable.

EXAMPLES 8 AND 9

These Examples demonstrate the connection between gloss stabilisation of the fibres and thermomechanical behaviour.

Fibres with a denier of 3.3 dtex of the same modacrylic polymer as used in Examples 6 and 7 were dry spun from DMF solution, drawn in two stages in a ratio of 1:1.63 × 2.45, as described in Example 1, and further aftertreated as follows:

| Example No. | 8 | 9 |
|---|---|---|
| Drying temperature (° C) | 160 | 140 |
| Permitted shrinkage (%) | 15 | 15 |
| Residual tow shrinkage (%) | 10.2 | 15 |
| Steam fixing | | |
| Quantity of steam (kg/h) | 400 | 400 |
| Temperature (° C) | 108 | 108 |
| Residence time (min/sec) | 1'48" | 4'30" |
| Fibre values: | | |
| Denier (dtex) | 3.3 | 3.3 |
| Moisture (%) | 2.1 | 3.6 |
| Fibre shrinkage (%) | 0.2 | 0 |
| Yarn shrinkage (%) | 4.0 | 2.0 |
| Scattered light measurement | | |
| a) untreated | 3 | 4 |
| b) boiled | 80 | 30 |

Thermomechanical analyses, made with 10 mp/dtex biasing and at a heating rate of 10° C/min, produced the following results:

| Example No. | 8 | 9 |
|---|---|---|
| Beginning of thermal expansion (° C) | 73 | 81 |
| End of thermal expansion (° C) | 171 | 189 |
| Beginning of thermal shrinkage (° C) | 192 | 207 |
| End of thermal shrinkage (° C) | 207 | 213 |
| Degree of thermal shrinkage (%) | 2.1 | 0.9 |

Comparison of these two Examples shows that the more gloss-stable fibres also have the lower thermal shrinkage and higher dimensional stability.

EXAMPLES 10 TO 13

These Examples demonstrate the influence of the composition of the polymer upon the production of a gloss-stable fibre with homogeneous structure.

Three different modacrylic copolymers of acrylonitrile, vinylidene chloride and methallyl sulphonic acid with the composition indicated below were dry spun from dimethyl formamide and washed and drawn in hot water in the same way as described in the preceding Examples. After drying, crimping and cutting, all three fibres were subjected to continuous steam fixing for 1 minute 48 seconds. Thereafter none of the fibres were found to be gloss-stable, as shown by scattered light measurements. The difference in the ability of the fibres to assume gloss stability is emphasized by a second batch-type pressure steaming treatment carried out at 0.7 bar excess pressure over a period of 3 minutes. Scattered light measurement showed that only the fibres of Example 10 with the higher conductivity of the polymer showed the required stabilization. (In the scattered light measurements, (a) means that the fibres are measured in untreated form, whilst (b) means that they are measured in boiled form. The reference value is a $BaSO_4$ standard of 1000 scale units).

| Example No. | 10 | 11 | 12 | 13 |
|---|---|---|---|---|
| Polymer | | | | |
| K-value | 80.4 | 79.2 | 80.3 | 79.1 |
| Chlorine content (%) | 28.3 | 31.3 | 35.0 | 28.2 |
| Conductivity of a 1% solution in DMF (μS) | 32.8 | 27.0 | 24.7 | 24.7 |
| Fibres after continuous steaming (1.6 mins): | | | | |
| Denier dtex | 3.0 | 3.2 | 3.6 | 6.4 |
| Scattered light a) (Scale units) | 5 | 10 | 5 | 6 |
| Scattered light b) (Scale units) | 100 | 220 | 240 | 270 |
| Fibres after pressure steaming: | | | | |
| Denier dtex | 3.2 | 3.2 | 3.7 | 6.4 |
| Scattered light a) (Scale units) | 10 | 110 | 180 | 11 |
| Scattered light b) (Scale units) | 30 | 170 | 180 | 200 |

EXAMPLES 14 AND 15

These Examples show that the process according to the invention is not confined to copolymers of acrylonitrile vinylidene chloride and methallyl sulphonic acid. By copolymerising a 4th comonomer, it is also possible to obtain gloss-stable fibres providing the polymer has a conductivity of at least 30 μSiemens and providing the aftertreatment conditions include an adequate steam fixing stage.

| Example No. | 14 | 15 |
|---|---|---|
| Polymer: | | |
| K-value | 74.8 | 71.2 |
| Chlorine content (%) | 27.9 | 27.3 |
| Conductivity of a 1% solution(μS) | 44.6 | 47.2 |
| 4th comonomer (analyt.determined(%) | 1.71 methyl acrylate | 4.5 vinyl chloride |
| Spinning: | | |
| Solution concentration in DMF (%) | 37.5 | 38 |
| Spinneret | 360 bore | 360 bore |
| Duct denier (dtex) | 3120 | 3200 |
| Take-off (m/min) | 250 | 250 |
| Aftertreatment: | | |
| Drawing | 1:4.5 | 1:3.6 |
| Drawing temperature (° C) | 98 | 98 |
| Washing temperature (° C) | 78 | 80 |
| Drying temperature (° C) | 137–161 | 136–149 |
| Permitted shrinkage (%) | 20 | 0 |
| Steaming time (min) | 2.2 | 2.2 |
| Fiber values: | | |
| Denier (dtex) | 3.3 | 3.3 |
| Moisture (%) | 2.9 | 0.9 |
| Tensile strength (cN/dtex) | 2.6 | 2.8 |
| Elongation at break (%) | 45 | 38 |
| Scattered light measurement (scale units, $BaSO_4$ standard = 1000) | | |
| a) untreated | 20 | 15 |
| b) after boiling for 30 minutes | 30 | 30 |
| Visual vacoule assessment according to Example 1 after boiling | 1 | 0–1 |

What we claim is:

1. A gloss-stable modacrylic fibre and filament comprising 50 to 84% of acrylonitrile, 15 to 48% of vinylidene chloride and 2 to 5% of an olefinically unsaturated sulphonic acid or salt thereof, all percentages being by weight, having a shrinkage in boiling water of at most 0.3%, a reduction in density on treatment with boiling water of no more than 0.015 g/cc and a scattered light component after boiling of at most 35 units compared with a $BaSO_4$ standard of 1000 units, the increase brought about by treatment with boiling water amounting to no more than 30 units.

2. The gloss-stable modacrylic fibres and filaments of claim 1 which also comprises up to 15% by weight of at least one other copolymerizable compound.

* * * * *